US006702109B1

(12) United States Patent
Tabuchi

(10) Patent No.: US 6,702,109 B1
(45) Date of Patent: Mar. 9, 2004

(54) WET SHEET PACKAGE AND METHOD OF PRODUCING THE SAME

(75) Inventor: Kunihiro Tabuchi, Mitoyo-gun (JP)

(73) Assignee: Toa Machine Industry, Inc., Kagawa (JP)

( * ) Notice: Subject to any disclaimer, the term of this patent is extended or adjusted under 35 U.S.C. 154(b) by 0 days.

(21) Appl. No.: 10/049,475

(22) PCT Filed: Oct. 16, 2000

(86) PCT No.: PCT/JP00/07174

§ 371 (c)(1),
(2), (4) Date: Feb. 12, 2002

(87) PCT Pub. No.: WO02/32783

PCT Pub. Date: Apr. 25, 2002

(30) Foreign Application Priority Data

Apr. 23, 1999 (JP) ..... H11-115955

(51) Int. Cl.[7] ..... B65D 71/00
(52) U.S. Cl. ..... 206/233; 206/494; 53/133.4
(58) Field of Search ..... 206/210, 233, 206/494; 221/63; 53/412, 133.4; 383/66

(56) References Cited

U.S. PATENT DOCUMENTS 5,704,471 A * 1/1998 Yamada ..... 206/207
5,729,955 A * 3/1998 Yamada ..... 53/412
6,026,953 A * 2/2000 Nakamura et al. ..... 206/233
6,113,271 A * 9/2000 Scott et al. ..... 383/211

FOREIGN PATENT DOCUMENTS

| | | |
|---|---|---|
| JP | 9-142551 | 6/1997 |
| JP | 9-216672 | 8/1997 |
| JP | 9-226861 | 9/1997 |
| JP | 3051487 | 6/1998 |
| JP | 10-329878 | 12/1998 |
| JP | 11-79215 | 3/1999 |

* cited by examiner

*Primary Examiner*—David T. Fidei
(74) *Attorney, Agent, or Firm*—Jordan and Hamburg LLP

(57) ABSTRACT

A wet sheet package, in which wet sheets (2) used in wiping dirt off baby's body or the like are packaged, comprises a stack (1) of wet sheets (2), a hermitic packaging bag (3) storing the stack (1), a wet sheet takeout opening (4) formed in said packaging bag (3), and a cover unit (8) mounted on the opening (4) side of the packaging bag (3), wherein the cover unit (8) is mounted on the packaging bag (3) from outside through a pressure sensitive adhesive (10). With the package thus constructed, high speeds for production can be easily attained, the decrease of yield due to positional deviation of the cover unit (8), etc., can be prevented, and low cost, easy and efficient production is possible.

10 Claims, 11 Drawing Sheets

WET SHEET PACKAGE AND METHOD OF PRODUCING THE SAME

FIELD OF THE INVENTION

The present invention relates to a wet sheet package and a method of producing the same, and provides a wet sheet package and a method of producing the same, wherein the production can be easily speeded up, the decrease of yield due to positional deviation of a cover unit can be prevented, and low cost, easy and efficient production is made possible.

BACKGROUND ART

Some of the wet sheet packages in the form of wet sheets received in a packaging bag used to wipe dirt off a baby's body or the like have heretofore been provided with a cover unit on the takeout opening side of the packaging bag. Such cover unit-equipped wet sheet package comprises a stack of wet sheets impregnated with a cleaning liquid, medicine liquid or the like, a packaging bag made of a hermetic packaging sheet material, such as synthetic resin film, for storing said stack, a cover unit mounted on the opening side of the packaging bag, wherein when wet sheets are to be used, the cover body of the cover unit is opened to allow the wet sheets in the package to be taken out one by one through the takeout port.

This cover unit-equipped wet sheet package is produced, as described in Japanese Patent Kokai Hei 8-318977, conventionally by a method comprising the steps of forming an opening of suitable size in a packaging sheet material, integrally joining a cover unit to said packaging sheet material as by heat seal so as to correspond to said opening, feeding a stack to a position corresponding to the cover unit on the packaging sheet material, wrapping said stack in said packaging sheet material while sealing the packaging sheet material at required places as by heat seal, thereby forming a packaging bag for packaging the stack.

However, in the prior art, because of the steps, employed in producing wet sheet packages, of joining the unit cover to the opening side of the packaging sheet material, feeding the stack onto the packaging sheet material in alignment with the cover unit, and then wrapping the stack in the packaging sheet material so as to form a packaging bag, it is very difficult to speed up the production or high efficiency can hardly be attained, as compared with the type having no cover unit.

Further, the cover unit has to be disposed in a predetermined position, such as the middle of the upper surface of the packaging bag. However, the packaging bag is formed such that while conveying the packaging sheet material having the cover unit mounted thereon, the stack is fed onto the packaging sheet material; therefore, the packaging sheet material tends to be deviated owing to vibrations of the cover unit, or the like. As a result, when the packaging bag is formed such that the stack is wrapped in the packaging sheet material, the cover unit tends to deviate from the central region of the upper surface of the packaging bag, lowering the yield of wet sheet packages.

Therefore, since the conventional cover unit-equipped wet sheet package is difficult to produce at high speed and is low in production yield, there is a problem that the production cost drastically increases.

With the above in mind, the invention has for its object the provision of a wet sheet package, and a method of producing the same, wherein high speeds for production can be easily attained, the decrease of yield due to positional deviation of the cover unit, etc., can be prevented, and low cost, easy and efficient production is possible.

DISCLOSURE OF THE INVENTION

A wet sheet package according to the invention comprises a stack 1 of wet sheets 2, a hermitic packaging bag 3 storing said stack 1, a wet sheet takeout opening 4 formed in said packaging bag 3, and a cover unit 8 mounted on the opening 4 side of said packaging bag 3, wherein said cover unit 8 is mounted on said packaging bag 3 from outside through a pressure sensitive adhesive 10. Therefore, the cover unit 8 can be mounted after the production of the packaging bag 3, so that, as compared with the prior art, high speeds for production can be easily attained, the decrease of yield due to positional deviation of the cover unit 8, etc., can be prevented, and low cost, easy and efficient production is possible.

Further, a wet sheet package according to the invention is such that said cover unit 8 comprises an attaching base 11 having a takeout opening 9 corresponding to the opening 4 and stuck to said packaging bag 3 through the pressure sensitive adhesive 10, and a cover body 13 disposed in said attaching base 11 for opening and closing said takeout port 9, wherein said pressure sensitive adhesive 10 is positioned to surround the entire periphery of said opening 4. Therefore, the cover unit 8 is simple in construction and allows the user to open the cover body 13 as required to take out a wet sheet 2 in the inside through the takeout port 9 with ease. Further, the attaching base 11 can be easily and reliably stuck to the outer side of the opening 4 in the packaging bag 3 by the pressure sensitive adhesive 10.

Further, a wet sheet package according to the invention is such that said attaching base 11 has an opening/closing label 24 openably/closably stuck thereto through a pressure sensitive adhesive 26 for sealing said takeout port 9. Therefore, after a wet sheet 2 in the packaging bag 3 has been taken out, the takeout opening 9 can be easily and reliably sealed by the opening/closing label 24, preventing drying, etc. of the wet sheets 2.

Furthermore, a the wet sheet package according to the invention is such that said packaging bag 3 is formed with said opening 4 in the upper surface side of a packaging sheet material 6 which packages said stack 1, the packaging sheet material 6 having a longitudinal seal portion 5 formed on the lower surface side thereof for sealing the lug side of said packaging sheet 6 longitudinally of said stack 1, and transverse seal portions 7 formed in the opposite ends longitudinally of said stack 1 for sealing the opposite ends of said packaging sheet material 6. Thus, the packaging bag 3 is simple in construction and adhesion of the cover unit 8 to the packaging bag 3 is also easy.

A method of producing such wet sheet package according to the invention comprises a packaging bag producing step 39 for producing a packaging bag 3 for wrapping a stack 1 of wet sheets 2 in a hermetic packaging sheet material 6 so as to package said stack 1 in said packaging sheet material 6, and a cover unit mounting step 40 for mounting from outside a cover unit 8 on the wet sheet takeout opening 4 side of said packaging bag 3 produced by said packaging bag producing step 39. Therefore, as compared with the prior art, high speeds for production can be easily attained, the decrease of yield due to positional deviation of the cover unit 8, etc., can be prevented, and low cost, easy and efficient production is possible.

Further, a production method according to the invention is such that in producing a wet sheet package A by producing a packaging bag 3 for wrapping a stack 1 of wet sheets 2 in a hermitic packaging sheet material 6 so as to package said stack 1 in said packaging sheet material 6, said cover unit 8 is mounted from outside on the side of the wet sheet takeout opening 4 formed in said packaging sheet material 6 after said step 34 of wrapping said stack 1 in said packaging sheet material 6. Therefore, as in the above, high speeds for production can be easily attained, the decrease of yield due to positional deviation of the cover unit 8, etc., can be prevented, and low cost, easy and efficient production is possible.

Furthermore, a production method according to the invention is such that in the step preceding the step of producing the packaging bag 3 using the packaging sheet material 6, said cover unit 8 is mounted on the opening 4 side of said packaging sheet material 6. Therefore, there is no problem arising, such as one of the packaging bag 3 being torn by the urging of the cover unit 8.

Further, a production method according to the invention is such that when said cover unit 8 having an attaching base 11 with a takeout port 9 and a cover body 13 installed on said attaching base 11 for opening/closing said takeout port 9 is mounted on said packaging bag 3, a pressure sensitive adhesive 10 is applied to the attaching base 11 and said attaching base 11 is stuck to said packaging bag 3 through said pressure sensitive adhesive 10 with said takeout port 9 positioned to correspond to said opening 4. Therefore, as compared with the operation of applying the pressure sensitive adhesive 10 to the packaging bag 3 side, the present operation is easy to perform, and the oozing of the pressure sensitive adhesive 10 from the attaching base 11, etc. can be easily prevented.

BEST MODE FOR EMBODYING THE INVENTION

Figure 1:
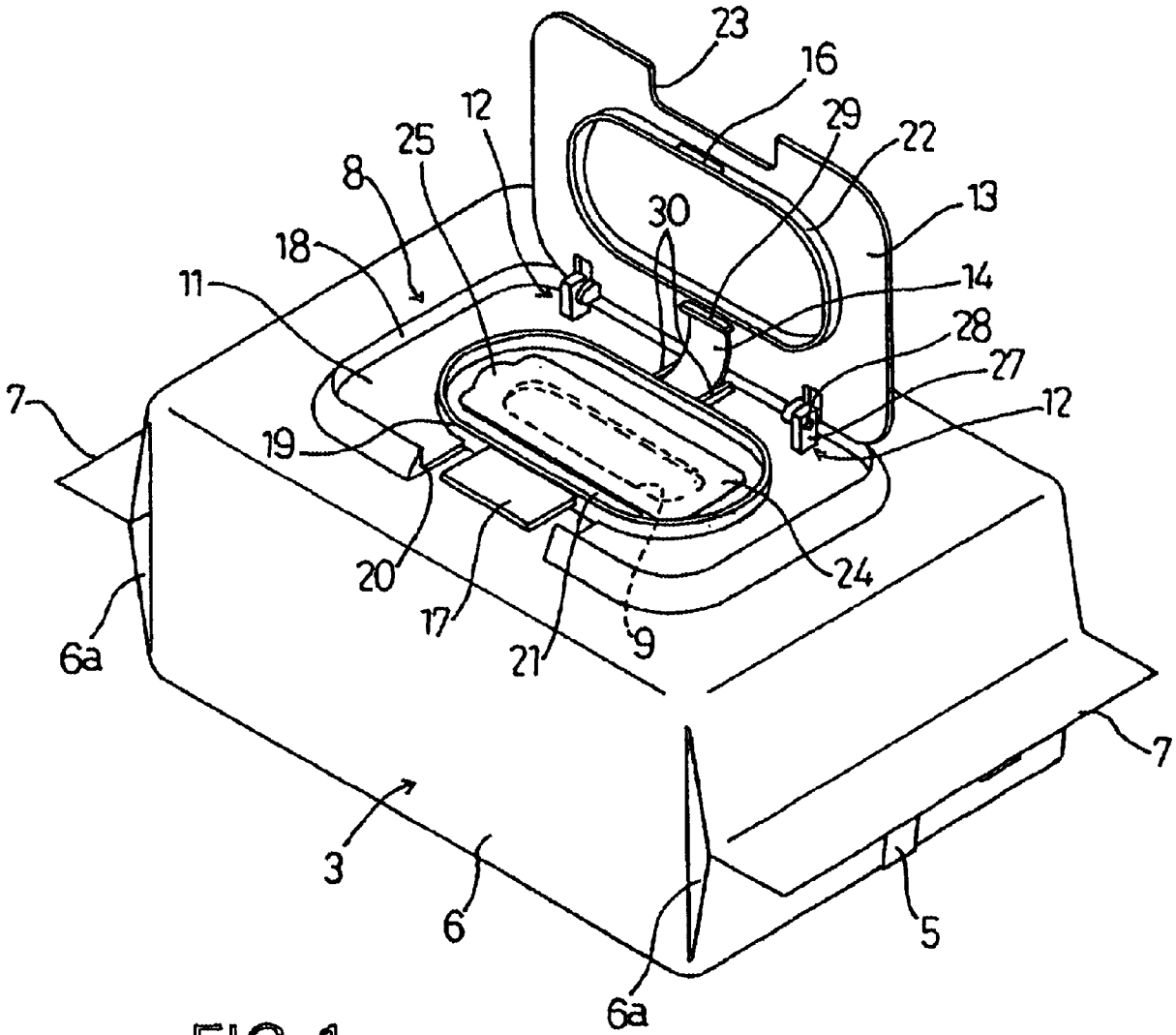
FIG. 1 is a perspective view showing the opened state of a wet sheet package according to a first embodiment of the invention.
Figure 2:
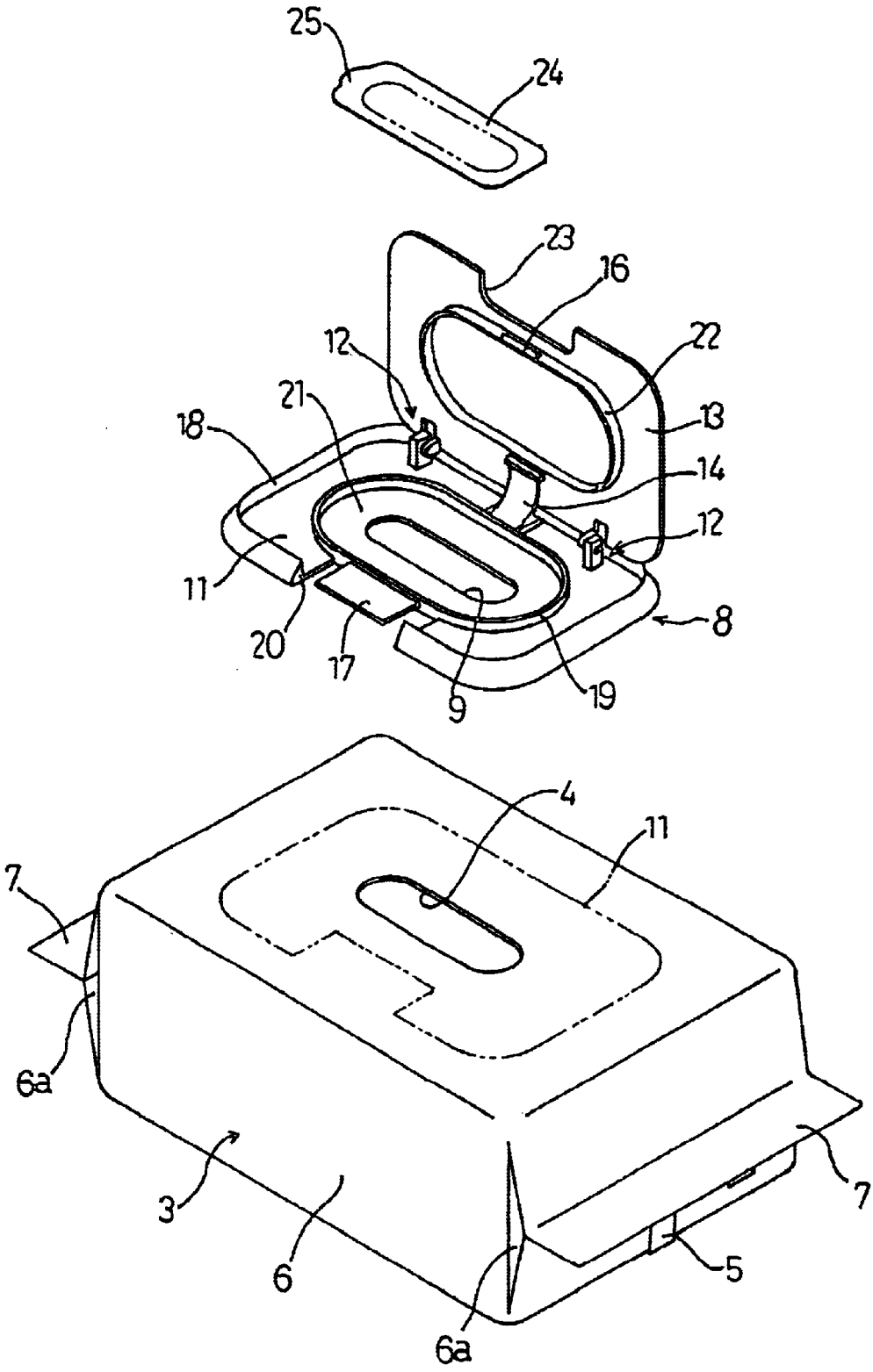
FIG. 2 is an exploded perspective view showing said opened state.
Figure 3:
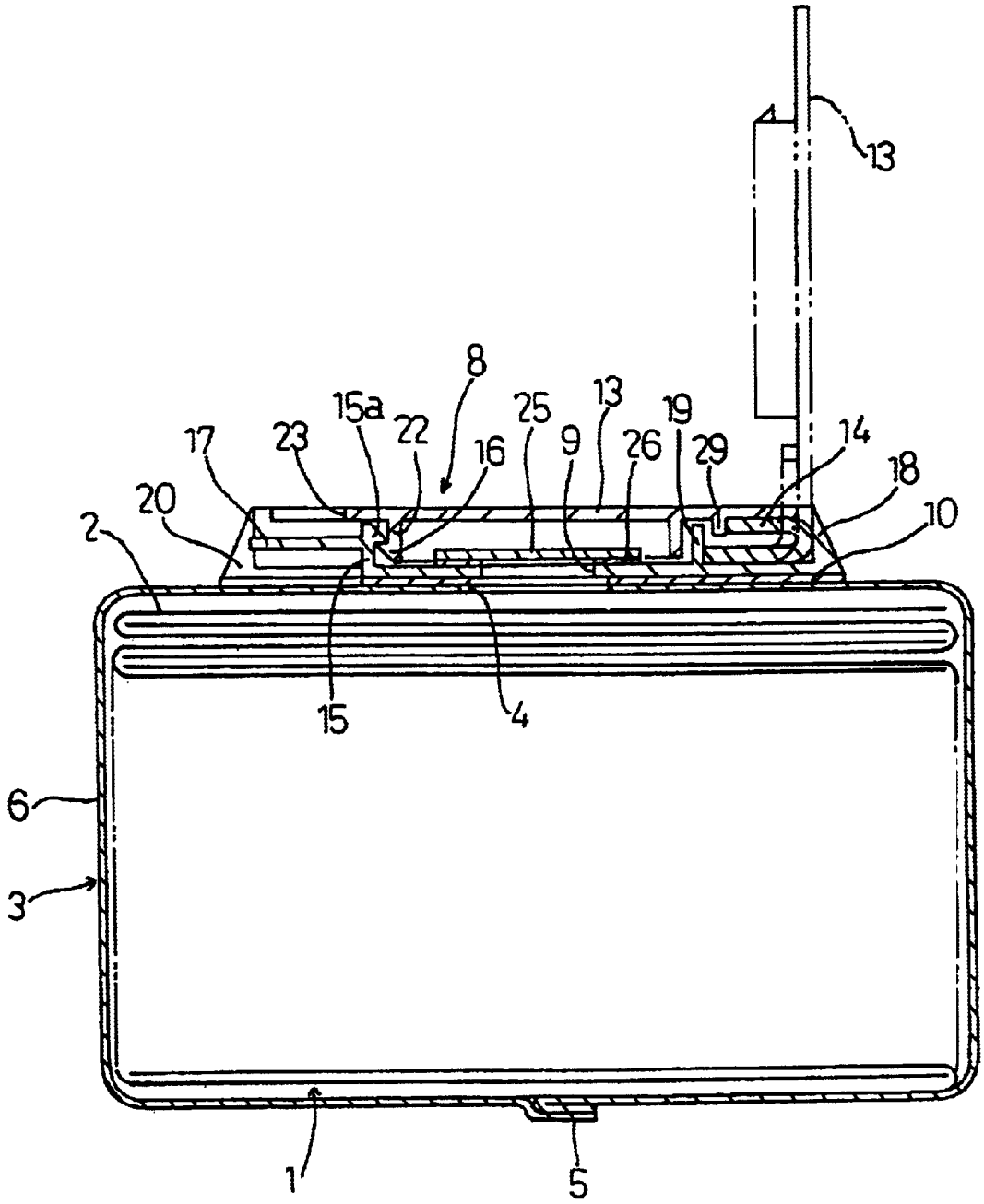
FIG. 3 is a cross sectional view showing said opened state.
Figure 4:
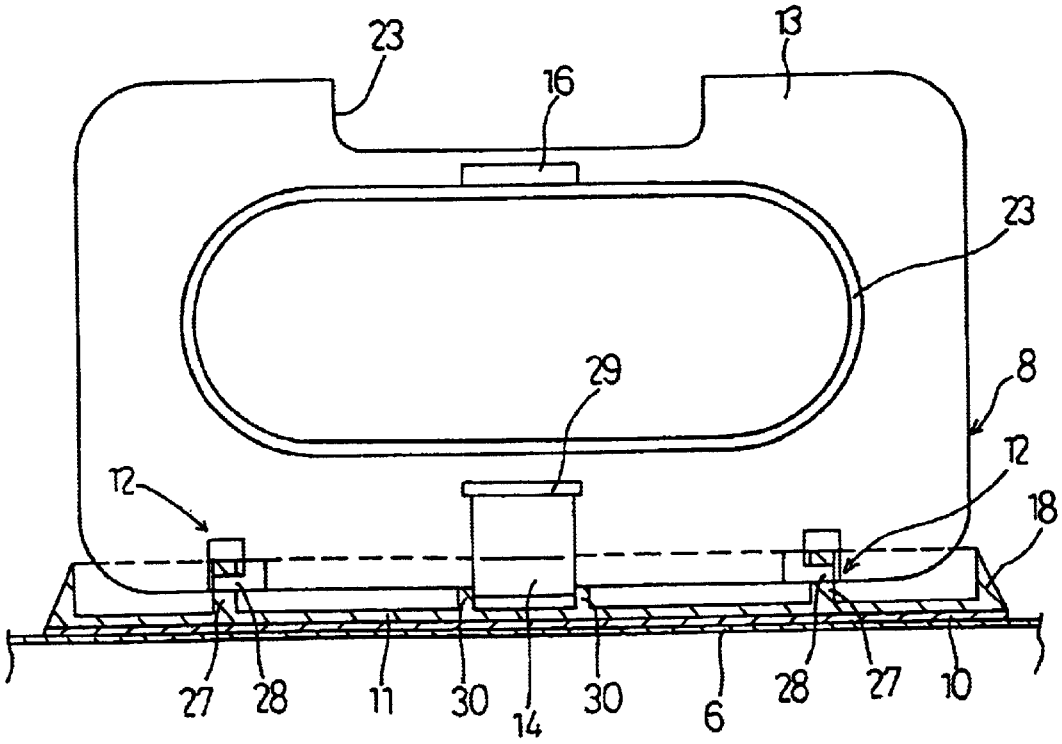
FIG. 4 is a longitudinal sectional view showing said opened state; 6
Figure 5:
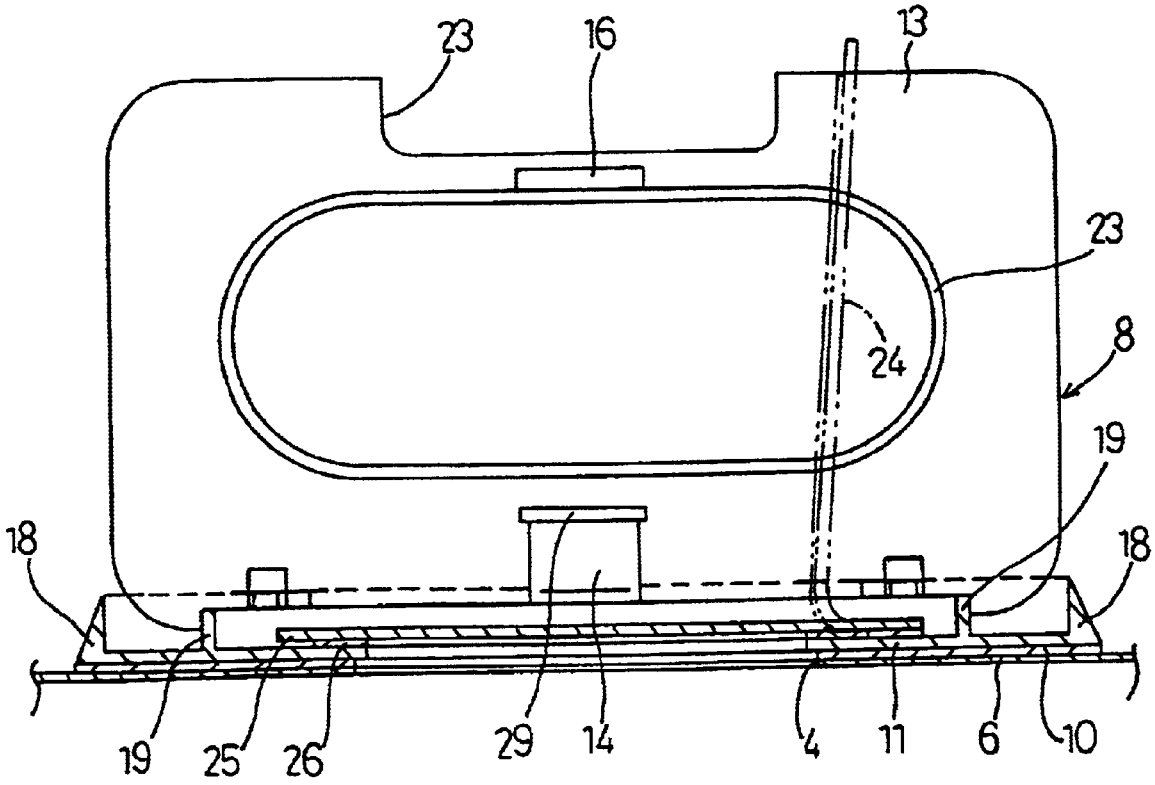
FIG. 5 is a longitudinal sectional view showing said opened state.

Embodiments of the invention will now be described in detail with reference to the drawings. FIGS. 1 through 8 illustrate a first embodiment of the invention. This wet sheet package A, as shown in FIGS. 1 through 5, comprises a stack 1 of wet sheets 2, such as wet towels, a packaging bag 3 for packaging the stack 1 in its stored state, and a cover unit 8 mounted on the packaging bag 3 from outside.

The stack 1 is obtained in that a plurality of wet sheets 2 folded in zigzag or in other form are stacked substantially in a cubic form as a whole. The wet sheets 2 are staked in such a manner that the ends of upper and lower wet sheets 2 are placed on each other over a predetermined range so that when a wet sheet 2 is taken out, the ends of the upper and lower wet sheets 2 coordinate with each other.

The packaging bag 3 is formed with an opening 4 above the upper surface side of the stack 1 for taking out wet sheets 2 and a cover unit 8 is stuck from outside to the upper surface so as to correspond to the opening 4. For the packaging bag 3, use is made of a hermetic packaging sheet material 6, for example, a single film, such as a synthetic resin film of polyethylene, polypropylene, polyester, polyamide, polyvinyl chloride, polyvinylidene chloride, cellophane, or acetate, a composite film of two or more of these materials, or a superposed film in the form of an aluminum foil superposed on such single or composite film.

The packaging bag 3 is sealed, with the stack 1 of the wet sheets 2 wrapped therein, such that the lower surface side opposite to the opening 4 is longitudinally sealed at a longitudinal seal portion 5 in the widthwise middle of the stack 1 and such that the longitudinal opposite ends of the stack 1 are sealed at transverse seal portions 7 through gussets 6*a*. In addition, the seal portions 5 and 7 are each joined by heat seal or any other joining method. The opening 4 is formed oval substantially in the middle of the upper surface side above and longitudinally of the stack 1.

The cover unit 8 comprises an attaching base 11 having a takeout port 9 formed therein and stuck to the upper surface side of the packaging bag 3 through a pressure sensitive adhesive 10, a cover body 13 openably/closably pivoted to the attaching base 11 by hinges 12, and an elastic body 14 interposed between the attaching base 11 and the cover body 13 on the hinge 12 side and urging the cover body 13 in the opening direction.

And, the cover unit 8 is provided on the attaching base 11 side with an fitting support portion 15*a* and on the cover body 13 side with an engaging portion 16 adapted to releasably engage the engaging support portion 15*a* when the cover body 13 is closed, and with an operating portion 17 for operating the engaging support portion 15*a* in the direction to release it from the engaging portion 16 when the cover body 13 is opened.

In addition, the attaching base 11 and cover body 13 of the cover unit 8 are each integrally formed of a synthetic resin material having a suitable degree of rigidity and elasticity.

The attaching base 11, which is long lengthwise of the stack 1, flat and substantially rectangular, is formed substantially in the middle with the oval takeout port 9 corresponding to the opening 4 in the packaging bag 3 and, besides this, it is integrally formed with an outer peripheral projecting edge 18 in the outer periphery, a fitting support portion 19, projecting upward, in the inner side thereof, and a notch 20 on the side opposite to the hinges 12.

The fitting support portion 19, which is in oval form surrounding the takeout port 9, is spaced a predetermined distance related to a label sticking portion 21 and formed in an oval shape in the outer peripheral side of the takeout port 9 and intermediate between the takeout port 9 and the outer peripheral projecting edge 18, integrally projecting in rib form from the attaching base 11. And, the fitting support portion 19 is integrally formed with an engaging support portion 15*a* in the inner side of the straight portion on the side opposite to the hinges 12 and with an operating portion 17 in the outer side thereof.

The operating portion 17 is in the form of a plate projecting outward from the fitting support portion 19 in substantially parallel with the attaching base 11. The notch 20 is formed on the side opposite to the hinges 12, extending from the outer side and in the vicinity of the fitting support portion 19 to stride across the outer peripheral projecting edge 18, the operating portion 17 being disposed in said notch 20.

The cover body 13 is in the form of a substantially rectangular plate of such size as to fit in the outer peripheral projecting edge 18 when it is closed. The cover body 13 is formed with a fitting projection 22 in the substantially middle lower side and a notch 23 corresponding to the operating portion 17, in the end edge on the side opposite to the hinges 12. The fitting projection 22 is adapted to fit in the fitting support portion 19 when the cover body 13 is closed. And it is formed in an oval shape as in the case of the fitting support portion 19, projecting downward in rib form from the cover body 13. And, an engaging portion 16 corresponding to the engaging support portion 15*a* is formed in the inner side of the straight portion of the fitting projection 22. In addition, the operating portion 17 has such a length as not to project into the outside from the outer peripheral projecting edge 18. An opening/closing label 24 to cover the takeout port 9 is openably/closably stuck to the label sticking portion 21 of the attaching base 11 through a pressure sensitive adhesive 26. The opening/closing label 24 is made of the same sheet material as the packaging sheet material 6 or other material and has an opening/closing knob 25 on one lengthwise end side and is peelably stuck to the label sticking portion 21 through the pressure sensitive adhesive 26.

The hinges 12, two in number, for example, are longitudinally arranged along the end edge on the side opposite to the operating portion 17 of the cover unit 8. Each hinge 12 comprises a projection 27 integral with the attaching base 11 on the inner side and in the vicinity of the outer peripheral projecting edge 18, and a pin 28 integral with the end edge side of the cover body 13, said pin 28 being rotatably inserted in a pin hole in the projection 27. In addition, instead of using the hinges 12, the cover body 13 may be pivotally connected at the bend to the attaching base 11.

For the elastic body 14, a rubber strip or the like is used, disposed substantially in the middle between the two hinges 12. The elastic body 14 is applied along the attaching base 11 and cover body 13, with its lengthwise opposite ends abutting against the fitting support portion 19 on the attaching base 11 side and a stop 29 on the cover body 13 side. On the attaching base 11 side, the elastic body 14 is held in position by holding ribs 30 on the opposite sides thereof.

Figure 6:
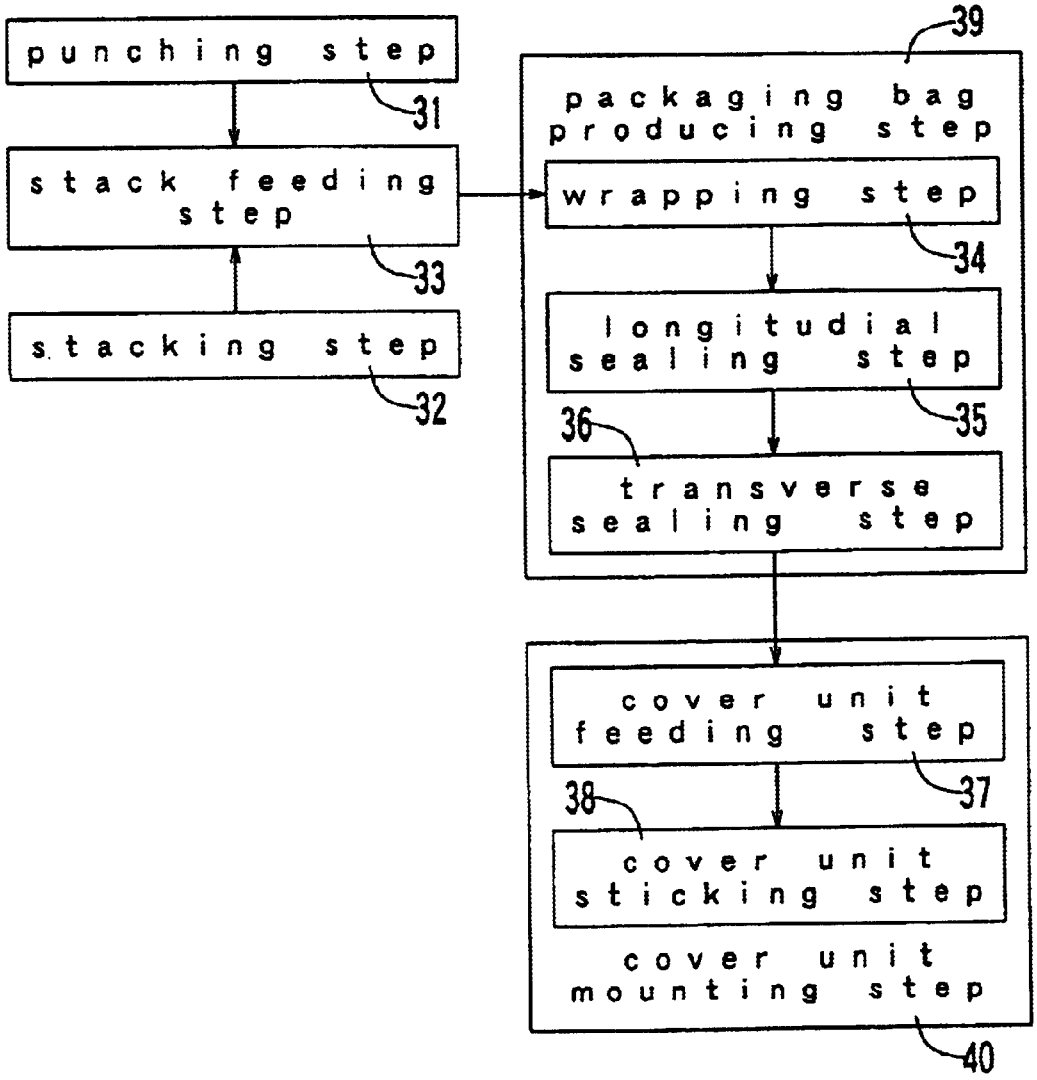
FIG. 6 is a block diagram showing a wet sheet package producing process.
Figure 7:
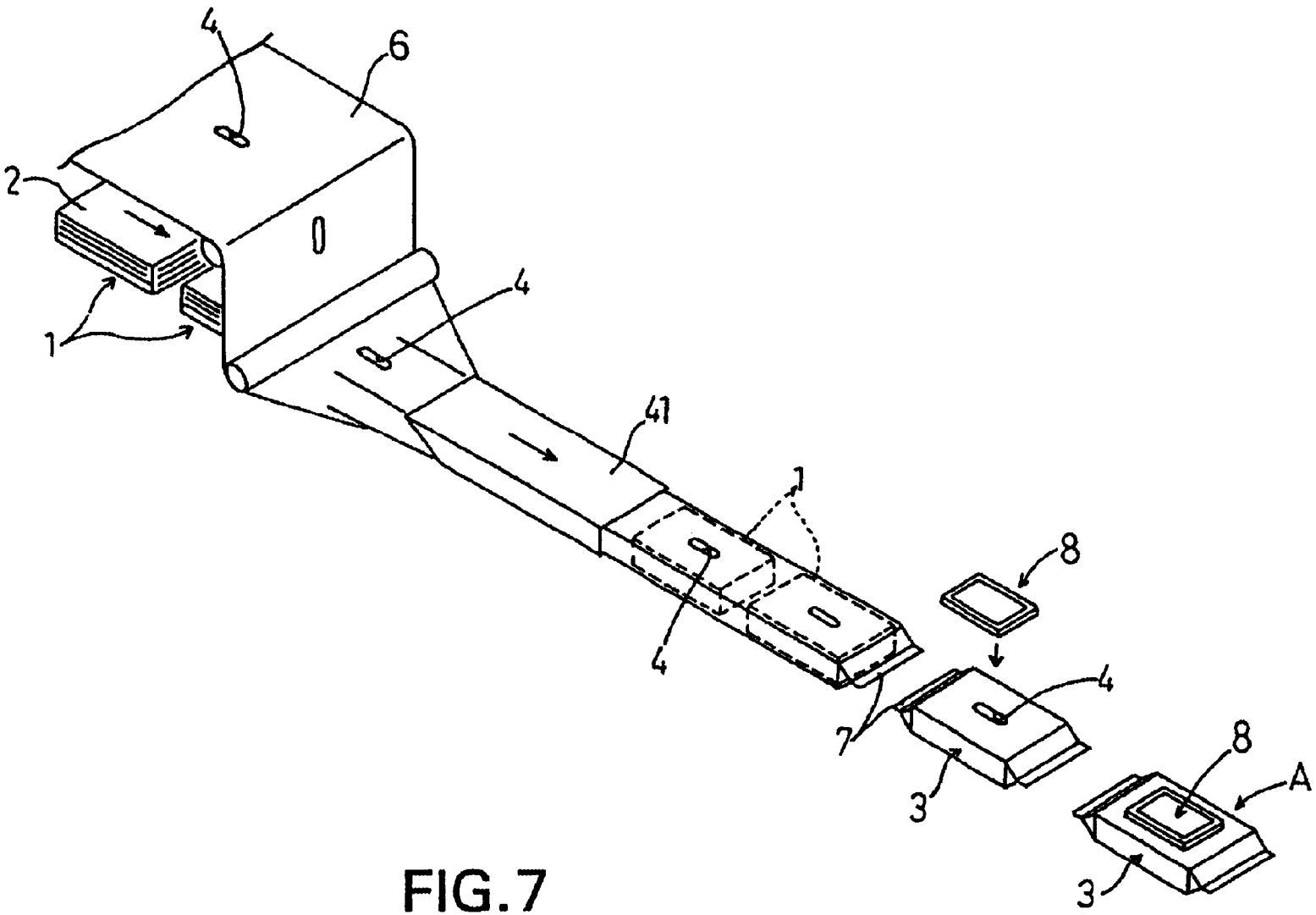
FIG. 7 is en explanatory view of the wet sheet package producing process.

This wet sheet package A is produced, as shown in FIGS. 6 and 7, through a punching step 31, a stacking step 32, a stack feeding step 33, a wrapping step 34, a longitudinal sealing step 35, a transverse sealing step 36, a cover unit feeding step 37, and a cover unit sticking step 38. In addition, the wrapping step 34, longitudinal sealing step 35 and transverse sealing step 36 constitute a packaging bag producing step 39, while the cover unit feeding step 37 and cover unit sticking step 38 constitute a cover unit mounting step 40.

First of all, in the punching step 31, the packaging sheet material 6 for packaging bags 3 is fed in the longitudinal direction while a punching means, not shown, successively forms openings 4 in the packaging sheet material 6 at a predetermined spacing. On the other hand, in the discrete stacking step 32, a plurality of wet sheets 2 are stacked to provide a stack 1.

And, in the stack feeding step 33, stacks 1 are fed to positions corresponding to individual openings 4 in this packaging sheet material 6 synchronously with the feed rate of the punched, packaging sheet material 6, and then in the wrapping step 34, the packaging sheet material 6 is wrapped around the outer periphery of the stack 1 while being guided by the guide means 41, whereby the stack 1 is wrapped therein.

Subsequently, in the longitudinal sealing step 35, with the opposite edges of the packaging sheet material 6 superposed on each other on the lower side of the stack 1, the edges are sealed along the feed direction to form a longitudinal seal 5, and the excessive edges of the packaging sheet material 6 are cut off by melting. And, in the transverse sealing step 36, the back side of the preceding stack 1 and the front side of the following stack 1 are each formed with a gusset 6*a*, and the front end of each gusset 6*a* is transversely sealed to form a transverse seal 7, whereupon the packaging sheet material 6 is severed between the two seals 7 to complete the production of the packaging bag 3 for the preceding stack 1.

Figure 8:
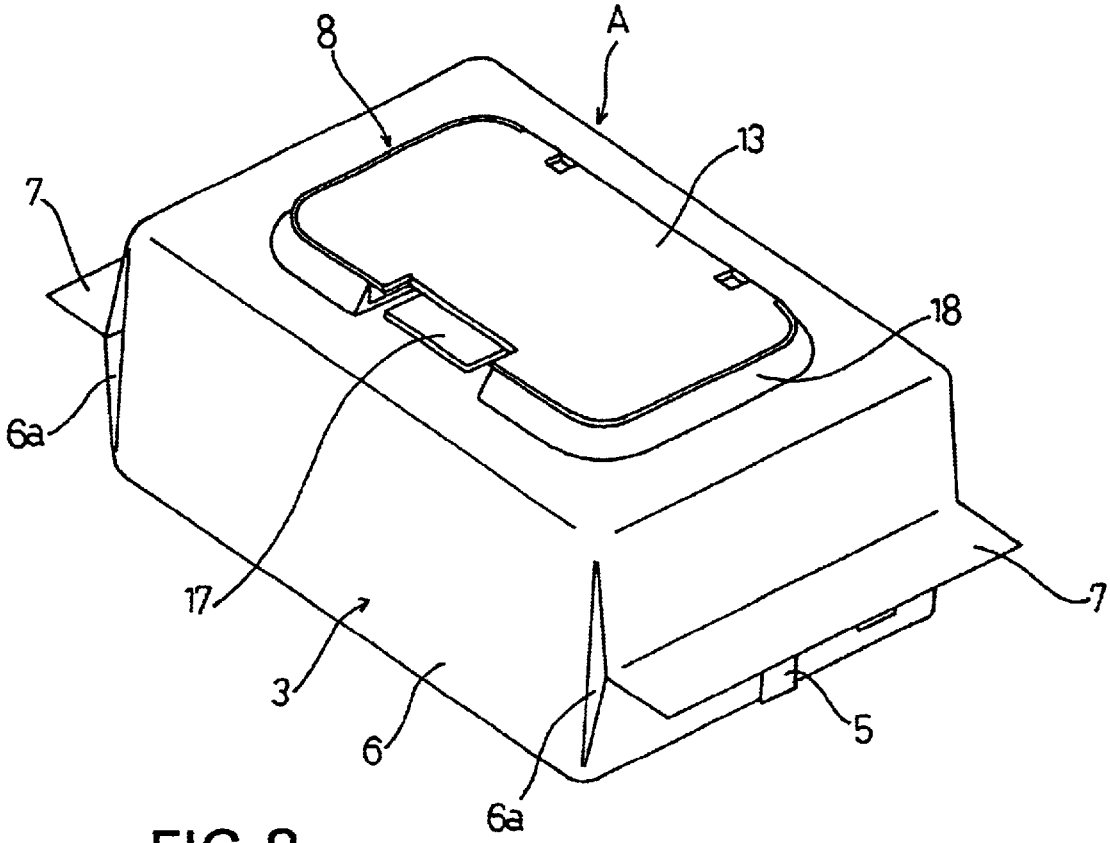
FIG. 8 is a perspective view of a wet sheet package.

And, when the production of the packaging bag 3 is completed, in the next cover unit feeding step 37, a cover unit 8 is fed to the opening 4 side of each packaging bag 3 and temporarily fixed in position by a pressure sensitive adhesive 10. In the cover unit sticking step 38, the cover unit 8 is urged against the packaging bag 3 side and the attaching base 11 is stuck from outside to the upper surface side of the packaging bag 3 through the pressure sensitive adhesive 10. In addition, the cover unit 8 has the pressure sensitive adhesive 10 applied in advance to substantially the entire surface of the attaching base 11 so as to surround the takeout port 9, and in this state, the cover unit 8 is fed. Of course, it is fed in the state in which the cover body 13 is closed, and attaching base 11 stuck to the packaging bag 3 through the pressure sensitive adhesive 10. Thereby, as shown in FIG. 8, the wet sheet package A can be produced with the stack 1 stored in the packaging bag 3, with the cover unit 8 provided on the opening 4 side of the packaging bag 3.

Employing the method in which after the stack 1 has been wrapped in the packaging sheet material 6 to produce the packaging bag 3 in this manner, the cover unit 8 is stuck to the opening 4 side through the pressure sensitive adhesive 10, provides the merits that high speeds for production of wet sheet packages A can be easily attained, that the decrease of yield due to positional deviation of the cover unit 8, etc., can be prevented, and that low cost, easy and efficient production is possible.

That is, until the packaging bag 3 is produced by wrapping the stack 1 in the packaging sheet material 6, it can be produced in substantially the same step as in the ordinary case having no cover unit 8. Further, in mounting the cover unit 8 on the packaging bag 3, the cover unit 8 has only to be stuck to the packaging bag 3 through the pressure sensitive adhesive 10; therefore, as compared with the conventional production method for producing the packaging bag 3 by wrapping the stack 1 in a packaging sheet material 6 equipped with a cover unit 8, high efficiency of production of wet sheet packages A can be easily attained.

Furthermore, since the cover unit 8 is stuck to the opening 4 side after the production of the packaging bag 3, there are merits that the position where the cover unit 8 is stuck to the packaging bag 3 is stabilized, that positional deviation of the cover unit 8, etc., can be easily prevented, and that the yield of wet sheet packages A improves. Further, since the attaching base 11 can be temporarily fixed on the opening 4 side of the packaging bag 3 by the pressure sensitive adhesive 10, positional deviation of the cover unit 8, etc., after it has been fed can be prevented. This, coupled with the attainment of high speeds for production described above, enables wet sheet packages A to be produced at low cost and easily and efficiently.

Further, the cover unit 8 is pressed against the packaging bag 3 side during the sticking of the cover unit 8; however, the presence of the opening 4 in the packaging bag 3 allows the air in the packaging bag 3 to be extracted outside through the opening 4, so that there is no problem such as one of the packaging bag 3 bursting due to the pressure produced during pressing.

This wet sheet package A has the attaching base 11 of the cover unit 8 stuck to the opening 4 side of the packaging bag 3 through the pressure sensitive adhesive 10 and the opening/closing label 24 stuck to the label sticking portion 21 of the attaching base 11, said opening/closing label 24 sealing the takeout port 9; therefore, the interior of the packaging bag 3 can be kept substantially hermetic, preventing the drying of the wet sheets 2.

When a wet sheet 2 inside the packaging bag 3 is to taken out for use, the operating portion 17 is pressed. Thereupon, the fitting support portion 19 side is elastically outwardly deformed by the pressing on the operating portion 17, so that the engaging portion 16 on the cover body 13 side is released from the engaging support portion 15*a* on the attaching base 11 side and the cover body 13 is turned open around the pins 28 of the hinges 12 by the urging force of the elastic body 14. In addition, the cover body 13 will stop in its elected state.

After the cover body 13 has been opened, the user pinches the knob 25 to peel the opening/closing label 24, opening the takeout port 9. In addition, the side of the opening/closing label 24 opposite to the knob 25 is fixed to the attaching base 11 at a position remote from the opening 4 or is made harder to peel than the other portion; in order to peel this opening/closing label 24, only the portion which closes the opening 4 may be peeled. This makes it possible to take out a wet sheet 2 inside the packaging bag 3 from the uppermost side of the stack 1 successively through the opening 4 and takeout port 9.

When the top wet sheet 2 is drawn out, part of the underlying wet sheet 2 is drawn out together with the overlying wet sheet 2 into the takeout port 9; thereafter, the following wet sheets 2 can be successively easily taken out through the takeout port 9 by pinching the portion projecting out of the takeout port 9.

After use, the opening/closing label 24 is stuck to the label sticking portion 21 to seal the takeout port 9, and then the cover body 13 is closed against the force of the elastic body 14, whereupon the engaging portion 16 engages the engaging support portion 15*a*. Therefore, the engagement between the engaging portion 16 and the engaging support portion 15*a* can easily lock and hold the cover body 13 in the closed state.

Figure 9:
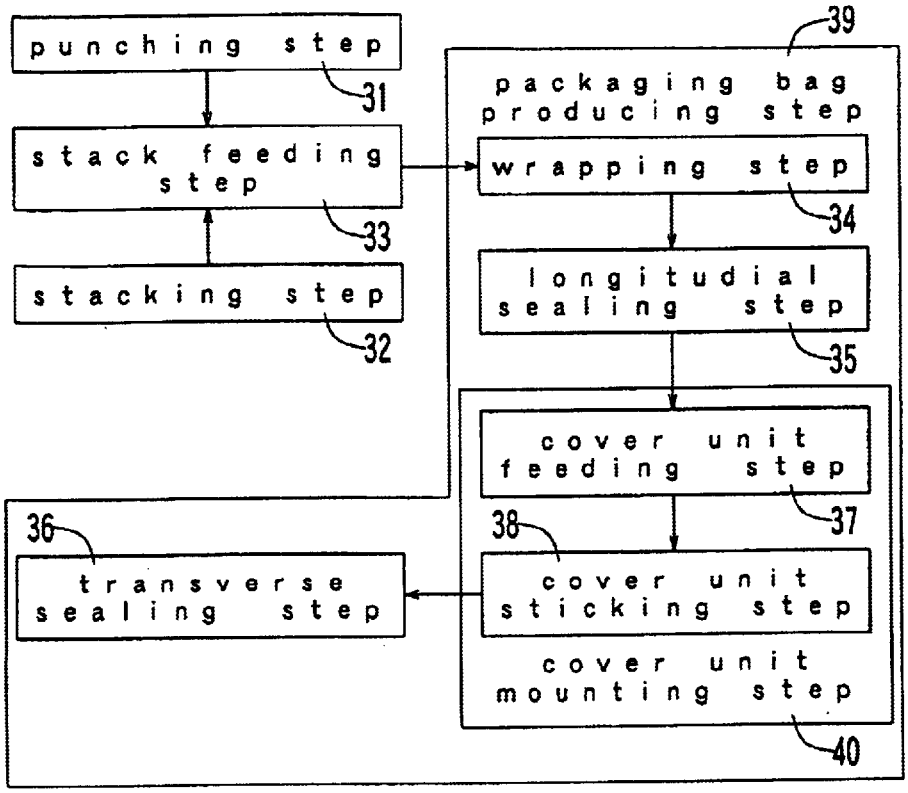
FIG. 9 is a block diagram showing a wet sheet package producing process according to a second embodiment of the invention.

FIG. 9 illustrates a second embodiment of the invention, wherein interposed between the longitudinal sealing step 35 and the transverse seal 36 are the cover unit feeding step 37 and the cover unit sticking step 38, so that the cover unit 8 is fed in the course of the packaging bag producing step 39 and stuck to the packaging sheet material 6.

That is, in producing wet sheet packages A, the stack 1 is wrapped in the packaging sheet material 6 in the wrapping step 34, and opposite edges of the packaging sheet material 6 are longitudinally sealed to form a longitudinal seal portion 5 in the longitudinal sealing step 35, and then the cover unit 8 is fed to the opening 4 side of the packaging sheet material 6 in the cover unit feeding step 37. And, the cover unit 8 is stuck to the opening 4 side of the packaging sheet material 6 in the cover unit sticking step 38, and then in the transverse sealing step 36 the transverse seal portions 7 are sealed to complete the production of the packaging bag 3.

Even in this manner, as compared with the case of using a packaging sheet material 6 having the cover unit 8 to wrap the stack 1 therein, high speeds for production can be easily attained, the decrease of yield due to positional deviation of the cover unit 8, etc., can be prevented, and low cost, easy and efficient production is possible. Further, even if the cover unit 8 is pressed against the stack 1 side in sticking the cover unit 8, since this is prior to sealing the transverse seal portions 7, there are no problems such as one of the packaging bag 3 bursting due to the pressure produced during pressing, so that the cover unit 8 can be firmly stuck to the packaging sheet material 6 by the pressure sensitive adhesive 10.

Figure 10:
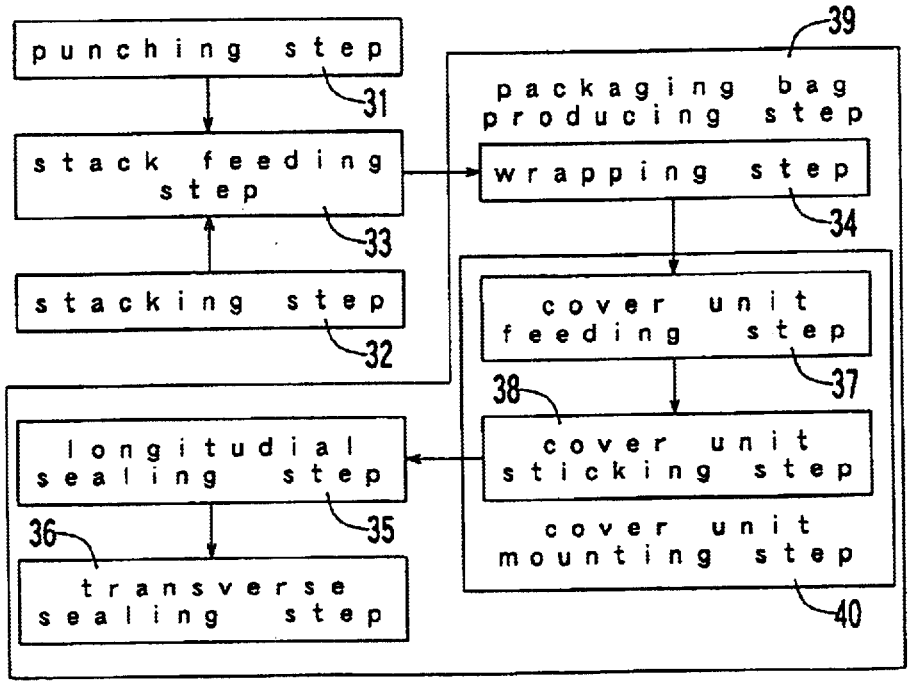
FIG. 10 is a block diagram showing a wet sheet package producing process according to a third embodiment of the invention.

FIG. 10 illustrates a third embodiment of the invention, wherein the wrapping step 34 is followed by the cover unit feeding step 37 and the cover unit sticking step 38, and the feeding and sticking of the cover unit 8 are performed substantially concurrently with the longitudinal sealing step 35.

In this embodiment also, when the stack 1 is wrapped in the packaging sheet material 6, a predetermined tension exists on the packaging sheet material 6 and there is no wrinkle or the like in the opening 4, so that it is possible, substantially concurrently with the sealing of the longitudinal seal portion 5, to temporarily fix and stick the cover unit 8 on the opening 4 side of the packaging sheet material 6. The same merits as those in the second embodiment are also attained in this embodiment.

Figure 11:
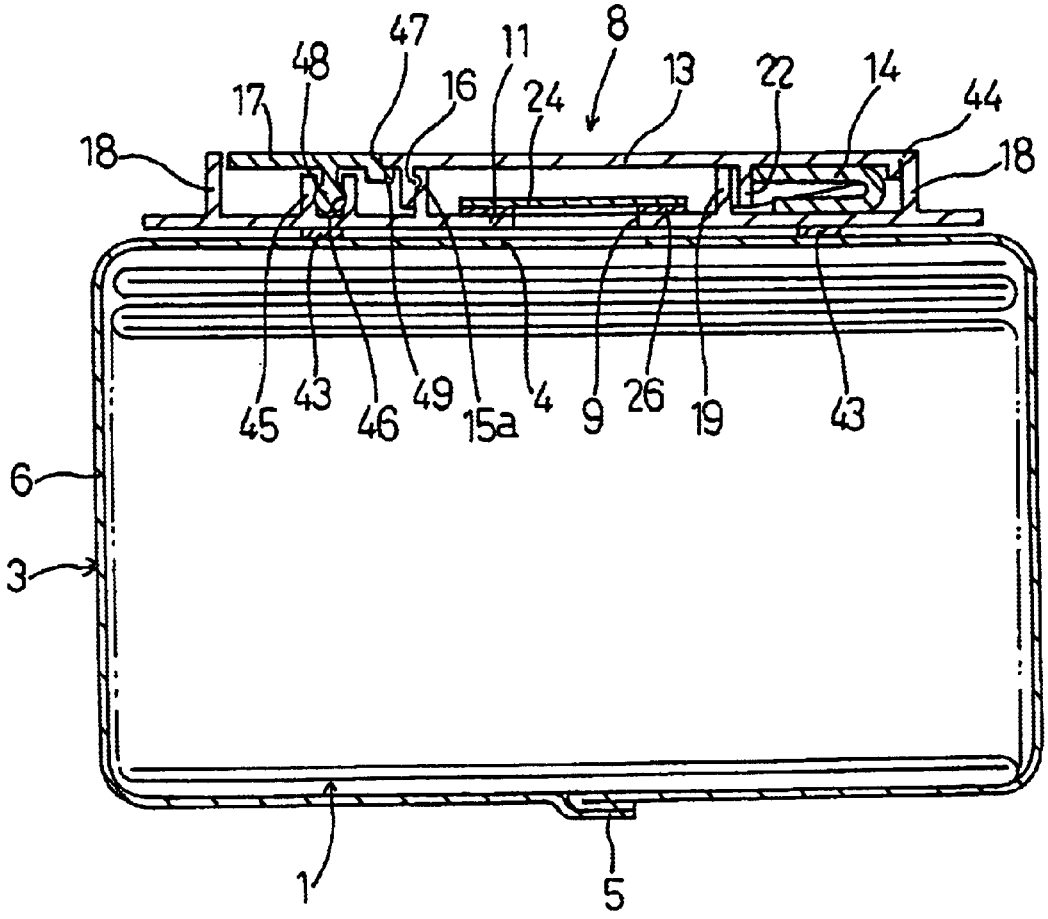
FIG. 11 is a longitudinal sectional view showing the closed state of a wet sheet package according to a fourth embodiment of the invention.
Figure 12:
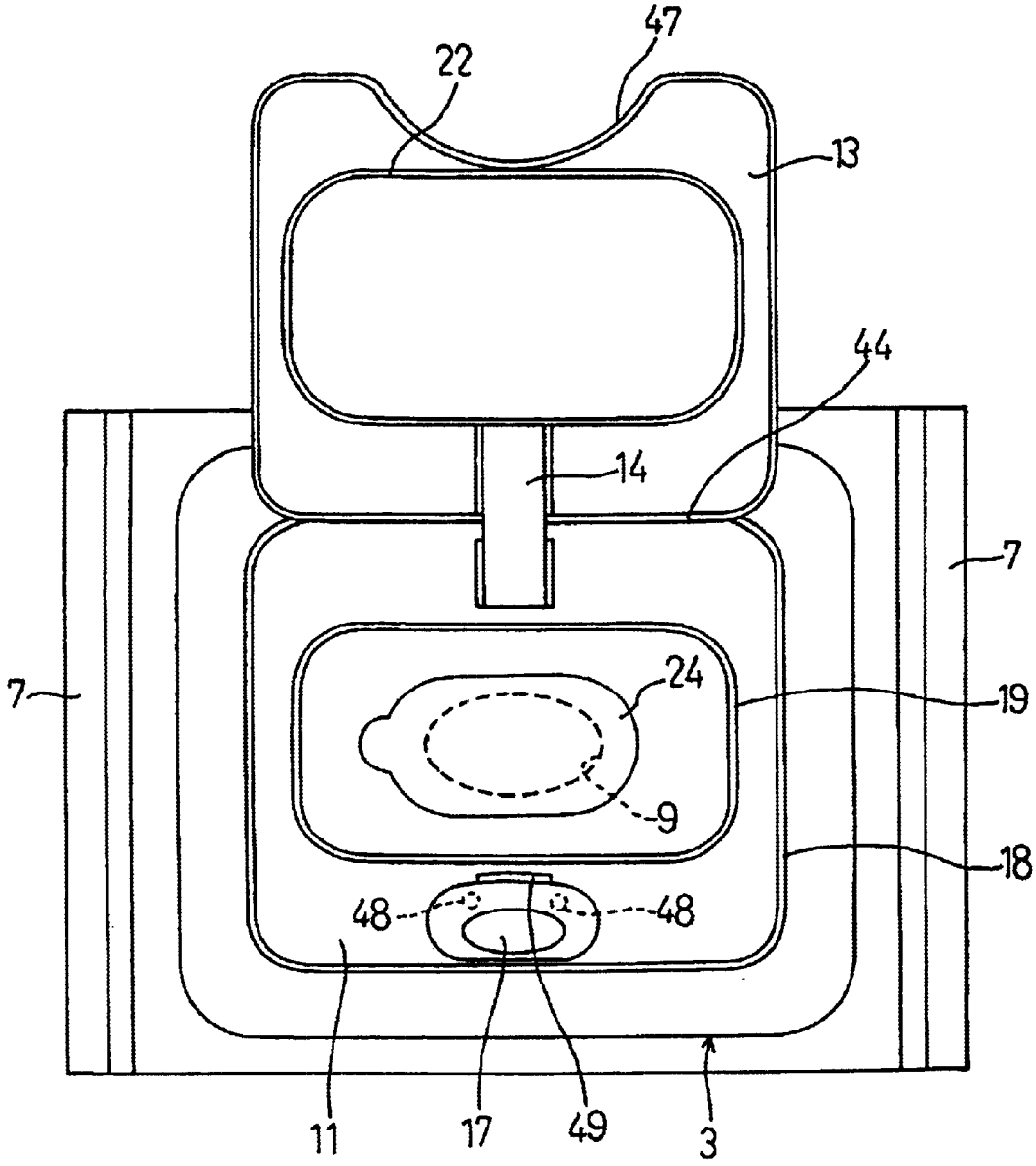
FIG. 12 is a plan view showing the opened state.

FIGS. 11 and 12 illustrate a fourth embodiment of the invention, wherein the attaching base 11 is stuck to the upper surface of the packaging bag 3 at hot melt portion 43, the cover body 13 is openably/closably and bendably connected to the attaching base 11 by a bend 44, and the operating portion 17 is removably attached to the holding portion 45 of the attaching base 11 on the side opposite to the bend 44 with respect to the cover body 13.

The attaching base 11 is circumferentially integrally formed with a upwardly projecting, outer peripheral projecting edge 18 and a fitting support portion 19, and a holding portion 45 having a recess 46 is integrally formed on the side opposite to the bend 44 and between the outer peripheral projecting edge 18 and the fitting support portion 19. The hot melt portion 43 is so formed as to surround the opening 4 in the packaging bag 3. The cover body 13 has a size such that it fits in the outer peripheral projecting edge 18, and is formed with a notch 47 on the side opposite to the bend 44.

In addition, the bend 44 is made by integrally molding or welding the outer peripheral projecting edge 18 of the attaching base 11 and the cover body 13, and through this bend 44 is the cover body 13 openably/closably connected to the attaching base 11. Therefore, the cover body 13 has only to be openably/closably connected to the attaching base 11, not always requiring the use of pin type hinges 12.

The fitting projection 22 of the cover body 13 is adapted to fit on the outer side of the fitting support portion 19 on the attaching base 11 side when the cover body 13 is closed, and an engaging portion 16 and an engaging support portion 15*a* are provided between the fitting projection 22 and the fitting support portion 19 and on the side opposite to the bend 44. The engaging portion 16 and the engaging support portion 15*a* are constituted by a projection and a recess. In addition, either the engaging portion 16 or the engaging support portion 15*a* may be a projection or a recess.

The operating portion 17 is disposed between the cover body 13 in its closed state and the outer peripheral projecting edge 18 so that when the cover body 13 is closed, the operating portion 17 corresponds to the interior of the notch 47, with the upper surface being substantially flush with the upper surface of the coverbody 13 in its closed state. The operating portion 17 has a pair of projections 48 on its lower side, said projections 48 being adapted to removably engage the recess 46 of the holding portion 45, whereby the operating portion 17 is mounted on the attaching base 11 side. And, this operating portion 17 has the engaging edge 49 on one end side thereof adapted to engage the lower side of the attaching base 11 and when it is pressed at the other end side thereof, the engaging edge 49 pushes up the cover body 13 in the opening direction with the projection 48 side serving as a fulcrum. In addition, the elastic body 14 is fixed at least at one end side thereof to the attaching base 11 side as by pressure sensitive adhesion and is abutted at the other end side against the fitting projection 22.

In this embodiment, after the stack 1 has been wrapped, it is only necessary to stick the attaching base 11 of the cover unit 8 to the upper side of the packaging bag 3 at the hot melt portion 43 in such a manner as to surround the opening 4. Therefore, the attaching base 11 of the cover unit 8 can be easily and firmly stuck to the packaging bag 3 even in the hot melt system without using the pressure sensitive adhesive 10 used in the first embodiment.

When the cover body 13 of the cover unit 8 is to be opened, the outer end side of the operating portion 17 is pressed, whereupon the angle of the operating portion 17 changes, with the intermediate projection 48 side serving as a fulcrum, and the engaging edge 49 pushed the end of the cover body 13 upward. This causes the engaging portion 16 to disengage the engaging support portion 15*a*, thereby allowing the cover body 13 to be turned open around the bend 44.

Embodiments of the present invention have been described so far, but the invention is not limited thereto. For example, in producing wet sheet packages A, substantially concurrently with the longitudinal sealing step 35 for sealing the longitudinal seal portion 5, the cover unit 8 may be fed and temporarily fixed and pressed against the stack 1 side to be stuck to the opening 4 side of the packaging sheet material 6.

Further, concurrently with the wrapping of the stack 1 in the wrapping step 34, the cover unit 8 may be fed and stuck. In other words, in the packaging bag producing step 39, the cover unit 8 can be mounted on the packaging sheet material 6 at a suitable point of time.

At the time of taking out a wet sheet 2, if it is desired to apply resistance to the following wet sheet 2 at the takeout port 9, this may be attained by making the size of the takeout port 9 smaller than that of the opening 4 on the packaging bag 3 side. Further, if it is desired to apply resistance on the opening 4 side of the packaging bag 3, reversely, the size of the opening 4 may be made smaller than that of the takeout port 9. In this case, the opening 4 may be oval as illustrated in the embodiments or it may be provided in the packaging bag 3 in slit form.

The cover unit 8 in the embodiments is also shown by way of example, and various changes are possible. Concerning the cover unit 8, the end edge of the cover body 13 may be bendably welded to part of the outer peripheral projecting edge 18 of the attaching base 11, or the attaching base 11 and the cover body 13 may be openably/closably connected together without using hinges 12 provided with pins 28, or the like, as by bendably integrally molding the outer peripheral projecting edge 18 and the cover body 13.

Besides, in the case where the opening 4 in the packaging bag 3 is smaller than the takeout port 9 of the attaching base 11, the opening/closing label 24 may be stuck to the packaging bag 3 side within the takeout port 9. In the case where the arrangement in which the opening/closing label 24 is stuck to the packaging bag 3 side is employed, the cover unit 8 may be of a construction having no sealing function.

Further, in the case where the opening/closing label 24 is to be provided on the packaging bag 3 side, a method may be employed in which a wet sheet package A having the opening 4 sealed by the opening/closing label 24, and a cover unit 8 having a releasing sheet stuck to the pressure sensitive adhesive 10 side, may be sold separately or as a set, so that before use the user removes the releasing sheet of the cover unit 8 and sticks the cover unit 8 to the packaging bag 3 through the pressure sensitive adhesive 10 in such a manner that the opening/closing label 24 may be received in the takeout port 9.

In this case, if the attaching base 11 has been stuck to the packaging bag 3 by the pressure sensitive adhesive 10, then when no wet sheet 2 is left inside, the cover unit 8 may be removed from the packaging bag 3 and stuck to a new one.

In addition, the attaching base 11 of the cover unit 8 may be bonded to the packaging bag 3 by other adhesive agent than the pressure sensitive adhesive 10 illustrated in the first embodiment, or it may be mounted by some other bonding method. Further, the hot melt system illustrated in the second embodiment or some other mounting system may be employed. In brief, the cover unit 8 has only to be mounted on the opening 4 side of the packaging bag 3, and means therefor is of no concern.

It is only necessary for the operating portion 17 of the cover unit 8 to be of such construction that when pressed, it is capable of canceling the engagement between the engaging portion 16 and the engaging support portion 15*a*, it would be possible to install it on the cover body 13 side, depending on the engagement construction. Further, the cover unit 8 may not be provided with an operating portion 17 and instead it may be so designed that the cover body 13 is opened by putting the user's finger or the like to the cover body 13 side.

INDUSTRIAL APPLICABILITY

As described above, the wet sheet package according to the invention is useful in that it contains wet sheets used either in wiping dirt off the body for babies, etc., or in wiping dirt off OA equipment or other precision instruments, and the method of producing wet sheet packages according to the invention is very useful as such.

What is claimed is:

1. A wet sheet package comprising:

a stack of wet sheets;

a hermitic packaging bag storing said stack;

a wet sheet takeout opening being oval and formed substantially longitudinally of the stack in said packaging bag;

a cover unit mounted on the oval takeout opening side of said packaging bag, said cover unit including:

an attaching base having an oval takeout port corresponding to the oval takeout opening and joined to the packaging bag;

a cover body connected to the attaching base by a connecting portion for opening and closing said oval takeout port;

an elastic body interposed between the attaching base and the cover body on the connecting portion side and urging the cover body in the opening direction;

an outer peripheral projecting edge disposed projecting upward in the outer periphery of the attaching base;

a fitting support portion being oval and surrounding the takeout port in an inner side of the attaching base and disposed projecting upward in rib form from the attaching base;

a fitting projection disposed projecting downward in rib form from the cover body and adapted to fit on an inner side of the fitting support portion when the cover body is closed, an engaging support portion disposed in the inner side of the straight portion of the fitting support portion on the side opposite to the connecting portion;

an engaging portion disposed in an outer side of the fitting projection and adapted to releasably engage the engaging support portion when the cover body is closed;

an operation portion projecting outward from the fitting support portion and substantially parallel with the attaching base;

a notch extending from the outer side and in the vicinity of the fitting support portion to stride across the outer peripheral projecting edge; and the operating portion being disposed in the notch;

the cover body fitting in the outer peripheral projecting edge when it is closed and having a notch corresponding to the operating portion; and said cover unit being mounted on said packaging bag from outside through a pressure sensitive adhesive.

2. A wet sheet package comprising:

a stack of wet sheets;

a hermitic packaging bag storing said stack;

a wet sheet takeout opening being oval and formed substantially longitudinally of the stack in said packaging bag;

a cover unit mounted on the takeout opening side of said packaging bag;

said cover unit including:

an attaching base having an oval takeout port corresponding to the takeout opening and joined to the packaging bag;

a cover body connected to the attaching base by a connecting portion for opening and closing said takeout port;

an elastic body interposed between the attaching base and the cover body on the connecting portion side and urging the cover body in the opening direction;

an outer peripheral projecting edge disposed projecting upward in the outer periphery of the attaching base;

a fitting support portion formed oval surrounding the takeout port in the inner side of the attaching base and disposed projecting upward in rib form from the attaching base;

a fitting projection disposed projecting downward in rib form from the cover body and adapted to fit on the outer side of the fitting support portion when the cover body is closed;

an engaging portion constituted by a projection or a recess and an engaging support portion constituted by a recess or a projection provided between the fitting projection and the fitting support portion and on the straight portion on the side opposite to the connecting portion;

a holding portion disposed in the side opposite to the bend and between the outer peripheral projecting edge and the fitting support portion and integrally formed on the attaching base;

a operating portion disposed in the a attaching base;

and an opening/closing label openably/closably joined to the attaching base to cover the takeout port through a pressure sensitive adhesive and having an opening/closing knob on one lengthwise end side, the cover body fitting in the outer peripheral projecting edge when it is closed and being formed with a notch corresponding to the operating portion, and the operating portion being disposed between the cover body in the closed state and the outer peripheral projecting edge with the upper surface being substantially flush with the upper surface of the cover body in the closed state, and having a pair of projections on a lower side, said projections being adapted to removably engage a recess of a holding portion, wherein the operating portion is mounted on the attaching base side, and has the engaging edge on one end side thereof adapted to engage the lower side of the edge of the cover body and when the operation portion is pressed at the other end side thereof, the engaging edge pushes up the cover body in the opening direction with the projection side serving as a fulcrum.

3. A wet sheet package comprising:

a stack of wet sheets;

a hermitic packaging bag storing said stack;

a wet sheet takeout opening being oval and formed on a side of said bag substantially longitudinally of the stack in said packaging bag;

a cover unit mounted on the oval takeout opening side of said packaging bag, said cover unit including:

an aching base having an oval takeout port corresponding to the oval takeout opening and joined to the packaging bag;

a cover body connected to the attaching base by a connecting portion for opening and closing said oval takeout port;

an elastic body interposed between the attaching base and the cover body on the connecting portion side and urging the cover body in the opening direction;

an outer peripheral projecting edge disposed projecting upward from an outer periphery of the attaching base;

a fitting support portion being oval and surrounding the takeout port on an inner side of the attaching base and disposed projecting upward in rib form from the attaching base;

a fitting projection disposed projecting downward in rib form from the cover body and adapted to fit on an inner side of the fitting support portion when the cover body is closed, an engaging support portion disposed in the inner side of the straight portion of the fitting support portion on the side opposite to the connecting portion;

an engaging portion disposed in an outer side of the fitting projection and adapted to releasably engage the engaging support portion when the cover body is closed;

an operation portion projecting outward from the fitting support portion and substantially parallel with the attaching base;

the fitting support portion having a notch extending from the outer side of the fitting support portion to stride across the outer peripheral projecting edge; and the operation portion being disposed in the notch;

the cover body fitting within the outer peripheral projecting edge when it is closed and having a notch corresponding to the operating portion; and said cover unit being mounted on said packaging bag from outside through a pressure sensitive adhesive.

4. A wet sheet package comprising:

a stack of sheets;

a hermitic packaging bag storing said stack;

a wet sheet takeout opening being oval and formed on a side of said bag substantially longitudinally of the stack in said packaging bag;

a cover unit mounted on the takeout opening side of said packaging bag; said cover unit including:

an attaching base having an oval takeout port corresponding to the takeout opening and joined to the packaging bag;

a cover body connected to the attaching base by a connecting portion for opening and closing said takeout port;

an elastic body interposed between the attaching base and the cover body on the connecting portion side and urging the cover body in the opening direction;

an outer peripheral projecting edge disposed projecting upward from an outer periphery of the attaching base;

a fitting support portion formed oval surrounding the takeout port on the inner side of the attaching base and disposed projecting upward in rib from from the attaching base;

a fitting projection disposed projecting downward in rib form from the cover body and adapted to fit on the outer side of the fitting support portion when the cover body is closed;

an engaging portion constituted by a projection or a recess and an engaging support portion constituted by a recess or a projection provided between the fitting projection and the fitting support portion and on the straight portion on the side opposite to the connecting portion;

a holding portion disposed on the side opposite to the bend and between the outer peripheral projecting edge and the fitting support portion and integrally formed on the attaching base;

a opening portion disposed on the attaching base;

and an opening/closing label openably/closably joined to the attaching base to cover the takeout port through a pressure sensitive adhesive and having an opening/closing knob on one lengthwise end side, the cover body fitting within the outer peripheral projecting edge when it is closed and being formed with a notch corresponding to the operating portion, and the operating portion being disposed between the cover body in the closed state and the outer peripheral projecting edge with the upper being substantially flush with the upper surface of the cover body in the closed state, and having a pair of projections on a lower side, said projections being adapted to removably engage a recess of a holding portion, wherein the operating portion is mounted on the attaching base side, and has the engaging edge on one end side thereof adapted to engage the lower side of the edge of the cover body and when the operation portion is pressed at the other end side thereof, the engaging edge pushes up the cover body in the opening direction with the projection side serving as a fulcrum.

5. A wet sheet package as set forth in claim 1 or 2, wherein said attaching base has an opening/closing label openably/closably stuck thereto through a pressure sensitive adhesive for sealing said oval takeout port.

6. A wet sheet package as set forth in claim 1, wherein said packaging bag is formed with said opening in the upper surface side of a packaging sheet material which packages said stack, the packaging sheet material having a longitudinal seal portion formed on the lower surface side thereof for sealing the lug side of said packaging sheet material longitudinally of said stack, and transverse seal portions formed in the opposite end sides longitudinally of said stack for sealing the opposite ends of said packaging sheet material.

7. A wet sheet package as set forth in claim 6, wherein said packaging sheet material is a single film in the form of a synthetic resin film, a composite film of two or more synthetic resin films, or a superposed film in the form of an aluminum foil superposed on such single or composite film.

8. A wet sheet package as set forth in claim 3 or 4, wherein said attaching base has an opening/closing label openably/closably stuck thereto through a pressure sensitive adhesive for sealing said oval takeout port.

9. A wet sheet package as set forth in claim 3, wherein said packaging bag is formed with said opening in the upper surface side of a packaging sheet material which packages said stack, the packaging sheet material having a longitudinal seal portion formed on the lower surface side thereof for sealing the lug said of said packaging sheet material longitudinally of said stack, and transverse seal portioned formed in the opposite end sides longitudinally of said stack for sealing the opposite ends of said packaging sheet material.

10. A wet sheet package as set forth in claim 9, wherein said packaging sheet material is a single film in the form of a synthetic resin film, a composite film of two or more synthetic resin films, or a superposed film in the form of an aluminum foil superposed on such single or composite film.

* * * * *